US009359945B2

(12) United States Patent
Lee et al.

(10) Patent No.: US 9,359,945 B2
(45) Date of Patent: Jun. 7, 2016

(54) VARIABLE COMPRESSION RATIO APPARATUS

(71) Applicant: Hyundai Motor Company, Seoul (KR)

(72) Inventors: Eun Ho Lee, Suwon-si (KR); Jin Kook Kong, Suwon-si (KR); Dong Seok Lee, Suwon-si (KR); Soo Hyung Woo, Yongin-si (KR); Yoonsik Woo, Yongin-si (KR)

(73) Assignee: Hyundai Motor Company, Seoul (KR)

( * ) Notice: Subject to any disclaimer, the term of this patent is extended or adjusted under 35 U.S.C. 154(b) by 75 days.

(21) Appl. No.: 13/722,362

(22) Filed: Dec. 20, 2012

(65) Prior Publication Data

US 2014/0014071 A1 Jan. 16, 2014

(30) Foreign Application Priority Data

Jul. 12, 2012 (KR) ..... 10-2012-0076231

(51) Int. Cl.
*F02B 75/04* (2006.01)

(52) U.S. Cl.
CPC ..... *F02B 75/047* (2013.01); *F02B 75/045* (2013.01)

(58) Field of Classification Search
CPC .... F02B 75/048; F02B 75/045; F02B 75/044; F02B 75/04; F02D 15/02
USPC ..... 123/48 B, 78 B, 78 BA, 78 E
See application file for complete search history.

(56) References Cited

U.S. PATENT DOCUMENTS

| | | | | |
|---|---|---|---|---|
| 5,417,185 | A * | 5/1995 | Beattie | 123/48 B |
| 6,779,495 | B2 * | 8/2004 | Yamada et al. | 123/78 E |
| 7,028,647 | B2 * | 4/2006 | Styron | 123/48 B |
| 2009/0139492 | A1 * | 6/2009 | Lee et al. | 123/48 B |

* cited by examiner

*Primary Examiner* — Lindsay Low
*Assistant Examiner* — Omar Morales
(74) *Attorney, Agent, or Firm* — Morgan, Lewis & Bockius LLP

(57) ABSTRACT

A variable compression ratio apparatus mounted on an engine configured to receive combustion force of a mixer from a piston to rotate a crankshaft, and configured to change a compression ratio of the mixer may include an eccentric bearing assembly connected with the piston through a piston pin, and including an eccentric ring including an eccentric hole through which the piston pin passes so that the piston pin may be rotatably installed while being eccentric to the eccentric ring, and an eccentric link connected to the eccentric ring to transfer rotation force thereof to the eccentric ring, a connecting rod including one end provided with a mounting hole into which the eccentric ring may be rotatably inserted, a central portion provided with an operation hole, wherein the eccentric link may be movable through the operation hole, and the other end rotatably connected to the crankshaft while being eccentric to the crankshaft, and a control shaft connected to the eccentric link and configured to rotate the eccentric bearing assembly.

16 Claims, 9 Drawing Sheets

VARIABLE COMPRESSION RATIO APPARATUS

CROSS-REFERENCE TO RELATED APPLICATION

The present application claims priority to Korean Patent Application No. 10-2012-0076231 filed on Jul. 12, 2012, the entire contents of which is incorporated herein for all purposes by this reference.

BACKGROUND OF THE INVENTION

1. Field of the Invention

The present invention relates to a variable compression ratio apparatus, and more particularly, to a variable compression ratio apparatus for varying a compression ratio of a mixer inside a combustion chamber according to an operation condition of an engine.

2. Description of Related Art

In general, thermal efficiency of a heat engine is increased when a compression ratio is high, and thermal efficiency of a spark ignition engine is increased when an ignition timing is advanced up to a predetermined level. However, when the ignition timing is advanced in a high compression ratio, abnormal combustion may be generated in the spark ignition engine, which causes damage to an engine, such that there is a limit in the advance of the ignition timing and thus it is necessary to bear output deterioration.

The variable compression ratio (VCR) apparatus is an apparatus for changing a compression of a mixer according to an operation condition of an engine. According to the variable compression ratio apparatus, fuel efficiency is improved by increasing the compression ratio of the mixer in a low load condition of an engine, and a generation of knocking is prevented and an engine output is improved by decreasing the compression ratio of the mixer in a high load condition of an engine.

In the variable compression ratio apparatus in the related art, a change in a compression ratio is implemented by changing a length of a connecting rod for connecting a piston and a crankshaft. As a type of variable compression ratio apparatus, a part for connecting the piston and the crankshaft includes a plurality of links, so that combustion pressure is directly transferred to the links. Accordingly, durability of the links is deteriorated.

Accordingly, a method of separately connecting the crankshaft to the piston without directly installing the variable compression ratio apparatus in the crankshaft has been sought. As a result of various experiments for the variable compression ratio apparatus, an apparatus of changing a compression ratio by using an eccentric bearing has attracted attention due to high operational stability. However, there is a problem in that it is difficult to combine the links for rotating the eccentric bearing without disturbing the rotation when considering a position and an operation condition of the crankshaft.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a variable compression ratio apparatus for effectively varying a compression ratio, providing a variable compression ratio apparatus having a simple structure and a simple assembling process, and providing a variable compression ratio apparatus which is effectively operated without disturbing rotation of a crankshaft.

In an aspect of the present invention, a variable compression ratio apparatus mounted on an engine configured to receive combustion force of a mixer from a piston to rotate a crankshaft, and configured to change a compression ratio of the mixer may include an eccentric bearing assembly connected with the piston through a piston pin, and including an eccentric ring including an eccentric hole through which the piston pin passes so that the piston pin is rotatably installed while being eccentric to the eccentric ring, and an eccentric link connected to the eccentric ring to transfer rotation force thereof to the eccentric ring, a connecting rod including one end provided with a mounting hole into which the eccentric ring is rotatably inserted, a central portion provided with an operation hole, wherein the eccentric link is movable through the operation hole, and the other end rotatably connected to the crankshaft while being eccentric to the crankshaft, and a control shaft connected to the eccentric link and configured to rotate the eccentric bearing assembly.

The operation hole communicates with the mounting hole

The operation hole is formed in a direction perpendicular to the crankshaft to be communicated with an outside.

The eccentric ring and the eccentric link are separately provided and coupled.

An insertion hole in which an end of the eccentric link connected with the eccentric ring is inserted is formed in one surface of the eccentric ring, so that the eccentric ring is coupled with the eccentric link.

A ball spring is coupled to an interior peripheral surface of the eccentric ring in which the insertion hole of the eccentric ring is formed, and a coupling recess corresponding to the ball spring is formed at the end of the eccentric link, so that the eccentric ring is coupled with the eccentric link.

The eccentric link may include a first eccentric link connected to the eccentric ring, a second eccentric link connected to the control shaft, and a third eccentric link connecting the first eccentric link to the second eccentric link.

A first link hole is formed at an end of the first eccentric link, and a second link hole is formed at an end of the third eccentric link, and the first eccentric link is coupled with the third eccentric link by a first shaft member inserted in the first link hole and the second link hole.

A third link hole passing through the first link hole in a side surface of the first link hole is formed at the end of the first eccentric link, and the end of the third eccentric link is inserted in the third link hole and coupled thereto by the first shaft member.

A fourth link hole is formed at an end of the second eccentric link, and a fifth link hole is formed at the other end of the third eccentric link, and the second eccentric link is coupled with the third eccentric link by a second shaft member inserted in the fourth link hole and the fifth link hole.

A sixth link hole passing through the fifth link hole in a side surface of the fifth link hole is formed at the other end of the third eccentric link, and the end of the second eccentric link is inserted in the sixth link hole.

In another aspect of the present invention, a variable compression ratio apparatus configured to change a compression ratio of a mixer flowing in a cylinder of an engine according to an operation condition of the engine, may include a piston vertically moving inside the cylinder, a crankshaft provided at a lower end of the cylinder to be rotated by a vertical movement of the piston, a balance weight connected to the crank shaft and reducing vibration generated during rotation of the crank shaft, an eccentric ring connected with the piston through a piston pin, and including an eccentric hole through which the piston pin passes so that the piston pin is rotatably installed while being eccentric to the eccentric ring, an eccentric link coupled with the eccentric ring to transfer rotation force to the eccentric ring, a connecting rod including one end provided with a mounting hole in which the eccentric ring is rotatably inserted, a central portion provided with an operation hole communicated with the mounting hole so that the eccentric link is movable inside the operation hole, and the other end rotatably connected to the crankshaft while being eccentric to the crankshaft, and a control shaft connected to the eccentric link and configured to rotate the eccentric bearing assembly.

The operation hole communicates with the mounting hole

The eccentric link may include a first eccentric link connected to the eccentric ring, a second eccentric link connected to the control shaft, and a third eccentric link connecting the first eccentric link to the second eccentric link.

An insertion hole in which an end of the first eccentric link is inserted is formed in one surface of the eccentric ring.

A ball spring is installed in an interior peripheral surface in which the insertion hole of the eccentric ring is formed, and a coupling recess corresponding to the ball spring is formed at the end of the first eccentric link.

According to the exemplary embodiments of the present invention, it is possible to effectively change a compression ratio.

Further, the present invention has a simple structure and a simple assembling process, thereby reducing manufacturing costs.

In addition, According to the exemplary embodiments of the present invention, it is possible to effectively operate without disturbing the rotation of the crankshaft.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
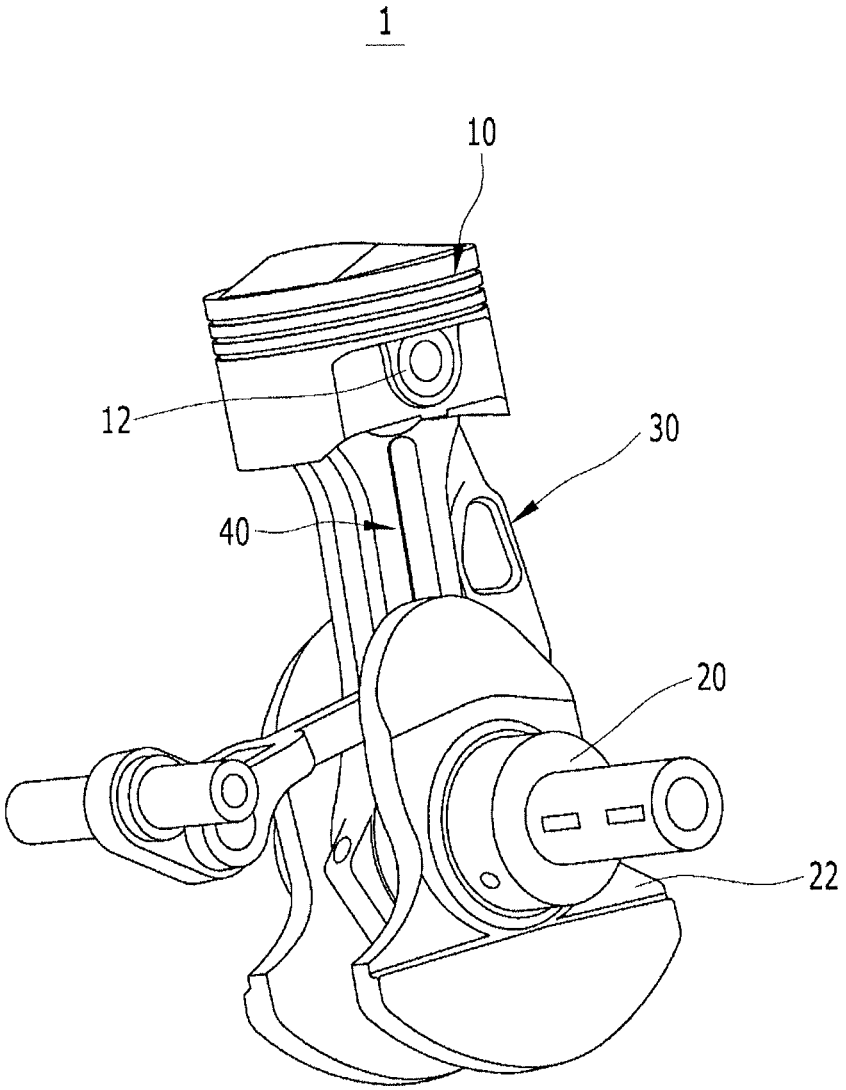
FIG. 1 is a perspective view schematically illustrating a variable compression ratio apparatus according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

The present invention will be described more fully hereinafter with reference to the accompanying drawings, in which exemplary embodiments of the invention are shown.

As those skilled in the art would realize, the described embodiments may be modified in various different ways, all without departing from the spirit or scope of the present invention.

Figure 2:
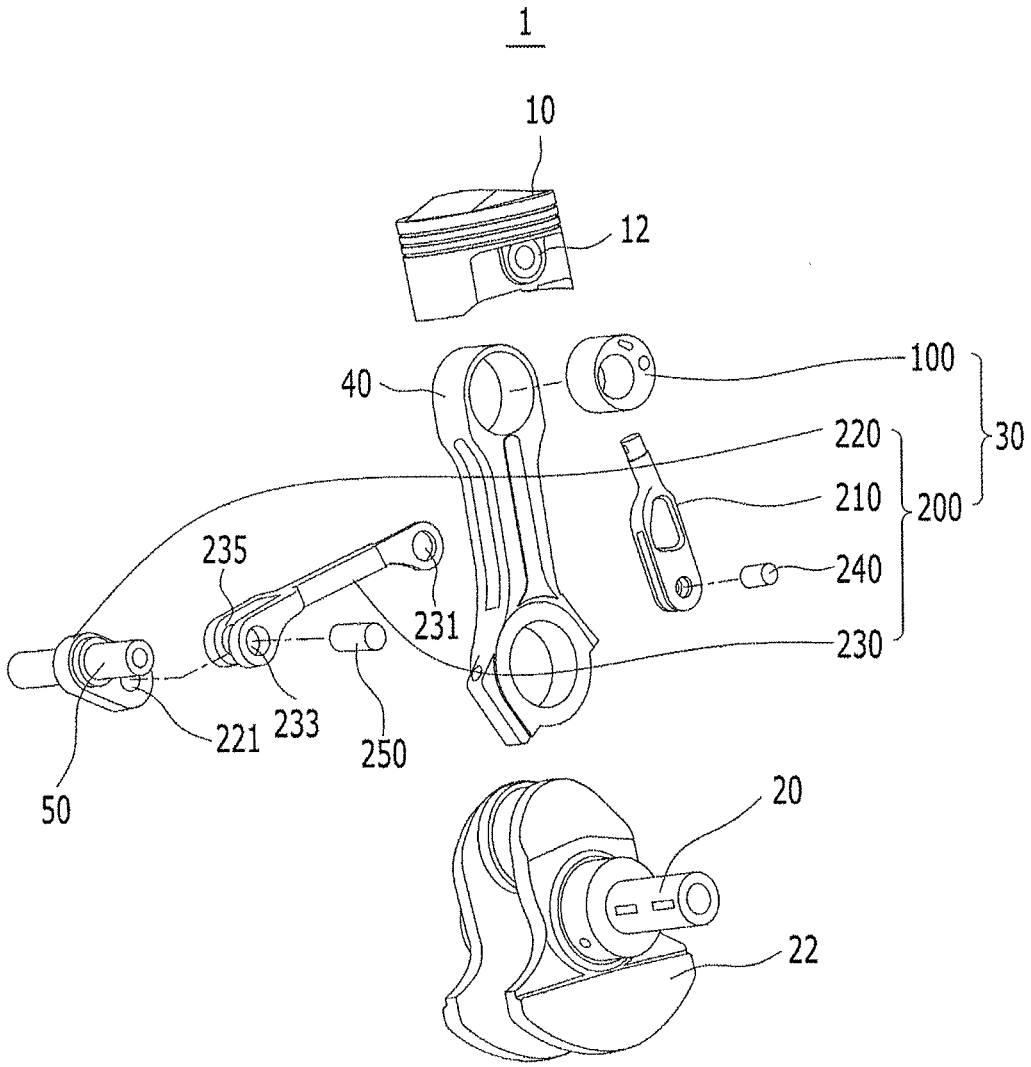
FIG. 2 is an exploded view schematically illustrating a variable compression ratio apparatus according to an exemplary embodiment of the present invention.
Figure 3:
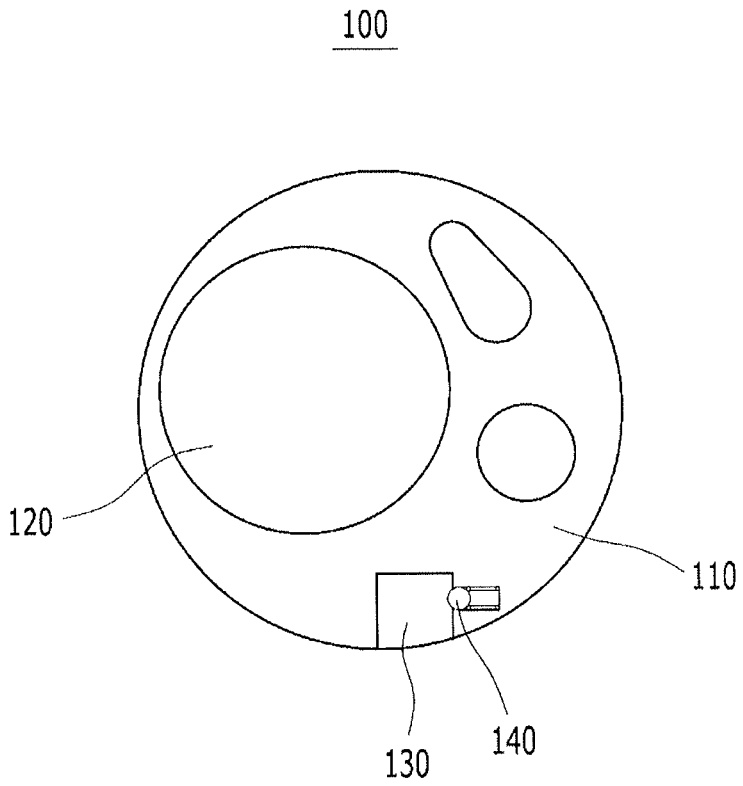
FIG. 3 is a cross-sectional view illustrating an eccentric ring according to an exemplary embodiment of the present invention.
Figure 4:
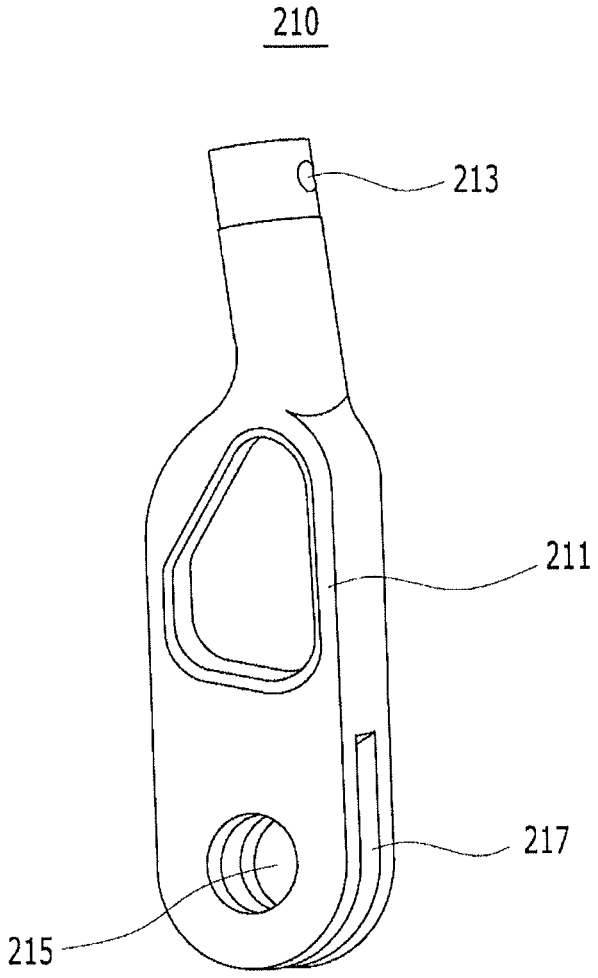
FIG. 4 is a perspective view illustrating a first eccentric link according to an exemplary embodiment of the present invention.
Figure 5:
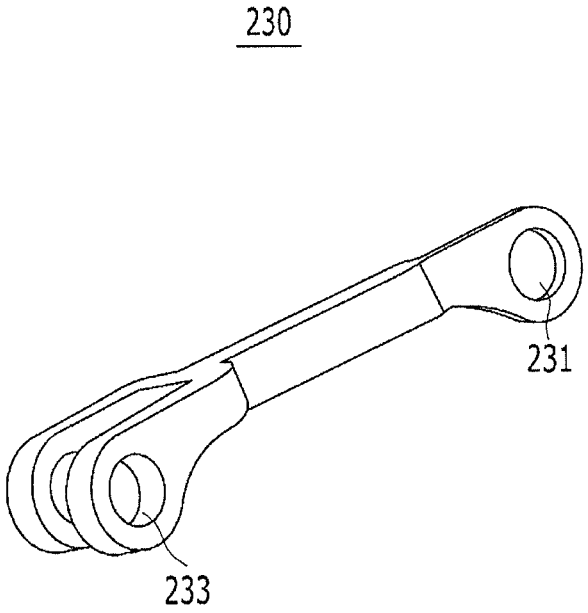
FIG. 5 is a perspective view illustrating a third eccentric link according to an exemplary embodiment of the present invention.
Figure 6:
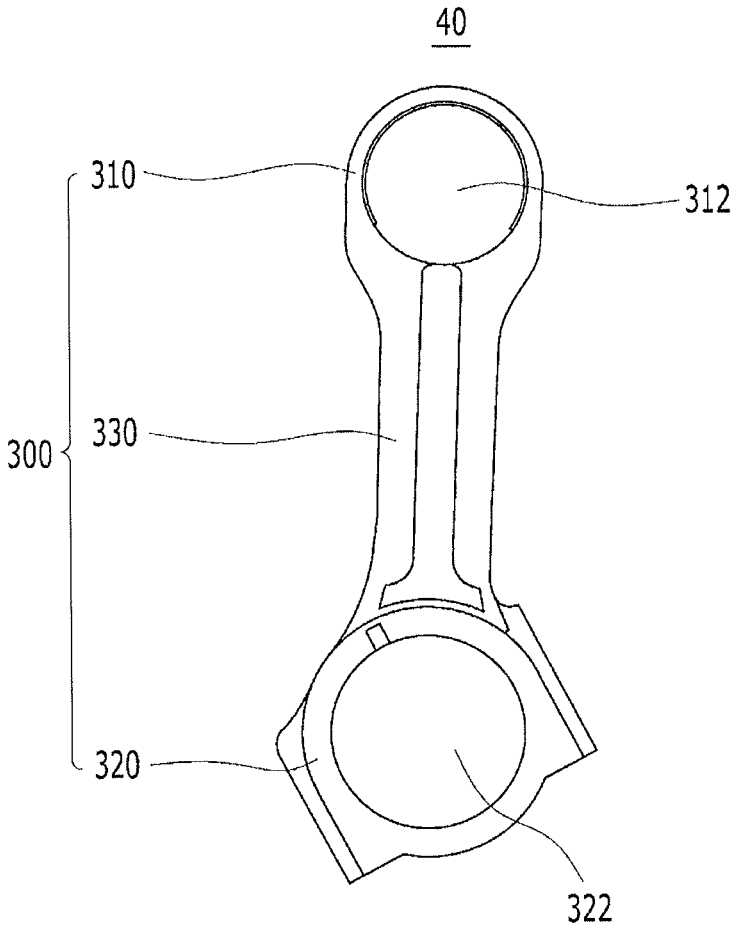
FIG. 6 is a front view illustrating a connecting rod according to an exemplary embodiment of the present invention.
Figure 7:
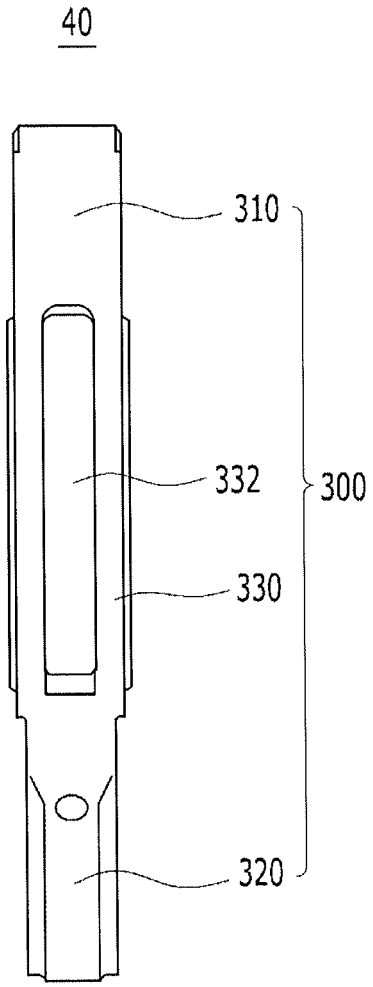
FIG. 7 is a side view illustrating a connecting rod according to an exemplary embodiment of the present invention.

FIG. 1 is a perspective view schematically illustrating a variable compression ratio apparatus according to an exemplary embodiment of the present invention, FIG. 2 is an exploded view schematically illustrating a variable compression ratio apparatus according to an exemplary embodiment of the present invention, FIG. 3 is a cross-sectional view illustrating an eccentric ring according to an exemplary embodiment of the present invention, FIG. 4 is a perspective view illustrating a first eccentric link according to an exemplary embodiment of the present invention, FIG. 5 is a perspective view illustrating a third eccentric link according to an exemplary embodiment of the present invention, FIG. 6 is a front view illustrating a connecting rod according to an exemplary embodiment of the present invention, and FIG. 7 is a side view illustrating a connecting rod according to an exemplary embodiment of the present invention.

A variable compression ratio apparatus 1 according to an exemplary embodiment of the present invention is mounted in an engine for rotating a crankshaft 20 by receiving combustion force of a mixer from a piston 10, and changes the compression ratio. The variable compression ratio apparatus 1 includes the piston 10, the crankshaft 20, an eccentric bearing assembly 30, a connecting rod 40, and a control shaft 50.

The piston 10 vertically moves inside a cylinder, and a combustion chamber is formed between the piston 10 and the cylinder.

The crankshaft 20 receives combustion force from the piston 10, converts the received combustion force to rotation force, and transfers the rotation force to a transmission. The crankshaft 20 is mounted inside a crank case formed at a lower end of the cylinder. Further, a plurality of balance weights 22 is mounted in the crank shaft 20. The balance weights 22 reduce rotational vibration generated during the rotation of the crankshaft 20.

The eccentric bearing assembly 30 is connected to the piston 10 through a piston pin 12, and changes a compression ratio by receiving rotation force of the control shaft 50 and adjusting a height of the piston 10 inside the cylinder.

Referring to FIGS. 2 to 4, the eccentric bearing assembly 30 includes an eccentric ring 100 and an eccentric link 200.

The eccentric ring 100 is provided in a ring shape including an eccentric hole 120 in which the piston pin 12 is eccentrically inserted within a body 110. The piston pin 12 is rotatable within the eccentric hole 120. However, the piston pin 12 is not limited thereto, and may be fixedly coupled with the eccentric ring 100.

The eccentric link 200 is connected with the eccentric ring 100 to transfer rotation force to the eccentric ring 100. The eccentric link 200 includes a first eccentric link 210, a second eccentric link 220, and a third eccentric link 230.

The first eccentric link 210 is connected to the eccentric ring 100. The first eccentric link 210 may be separately provided from the eccentric ring 100 to be female-male coupled with the eccentric ring 100. According to one example, an insertion hole 130 is formed in the eccentric ring 100 so that an end of the first eccentric link 210 may be inserted in the insertion hole 130. Further, a ball spring 140 is provided in an interior peripheral surface of the eccentric ring 100 in which the insertion hole 130 is formed, so that the ball spring 140 may be fastened to a coupling recess 213 formed at an end of the first eccentric link 210. However, the first eccentric link 210 is not limited thereto, and the first eccentric link 210 may be screwed onto the eccentric ring 100, and thus the first eccentric link 210 and the eccentric ring 100 may be fastened by the female-male coupling.

The second eccentric link 220 is coupled to the control shaft 50. The second eccentric link 220 is rotated by the rotation force of the control shaft 50. The second eccentric link 220 may be fixedly coupled to the control shaft 50, but is not limited thereto.

The third eccentric link 230 connects the first eccentric link 210 and the second eccentric link 220. The rotation force generated in the control shaft 50 is transferred to the first eccentric link 210 through the second eccentric link 220 and the third eccentric link 230, and the eccentric ring 100 is rotated by the rotation force transferred to the first eccentric link 210.

A first link hole 215 is formed at an end of the first eccentric link 210, and a second link hole 231 is formed at an end of the third eccentric link 230. The first eccentric link 210 is coupled with the third eccentric link 230 by a first shaft member 240 inserted in the first link hole 215 and the second link hole 231.

Further, a third link hole 217 passing through the first link hole 215 in a side surface in which the first link hole 215 is formed is formed at the first eccentric link 210. That is, an end of the first eccentric link 210 is formed while being divided into two ends based on the third link hole 217. Accordingly, the third eccentric link 230 is inserted in the third link hole 217 to be coupled to the first eccentric link 210 by the first shaft member 240 inserted in the first and second link holes 215 and 231.

A fourth link hole 221 is formed at an end of the second eccentric link 220, and a fifth link hole 233 is formed at the other end of the third eccentric link 230. The second eccentric link 220 is coupled with the third eccentric link 230 by a second shaft member 250 inserted in the fourth link hole 221 and the fifth link hole 233.

Further, a sixth link hole 235 passing through the fifth link hole 233 in a side surface in which the fifth link hole 233 is formed is formed in the third eccentric link 230. That is, an end of the third eccentric link 230 is formed while being divided into two ends based on the fifth link hole 233. Accordingly, the second eccentric link 220 is inserted in the sixth link hole 235 to be coupled with the third eccentric link 230 by the second shaft member 250 inserted in the fourth and fifth link holes 221 and 233.

The connecting rod 40 receives combustion force from the piston 10 and transfers the combustion force to the crankshaft 20.

Referring to FIGS. 2, 6 and 7, the connecting rod 40 includes a body 300 including one end 310, a central portion 320, and the other end 330.

A mounting hole 312 in which the eccentric ring 100 is rotatably inserted is formed at the one end 310 of the connecting rod 40. Accordingly, the connecting rod 40 is connected to the piston 10 through the eccentric ring 100 inserted in the mounting hole 312.

Further, a mounting hole 322 in which the crankshaft 20 is inserted is formed at the other end 330 of the connecting rod 40. Accordingly, the connecting rod 40 is rotatably connected to the crankshaft 20 through the mounting hole 322 while being eccentric to the crankshaft 20.

Further, an operation hole 332 communicated with the mounting holes 312 and 322 formed at the one end 310 and the other end 320 is formed at the central portion 330 of the connecting rod 40. The operation hole 332 provides a space in which the eccentric bearing assembly 30 may be operated. Particularly, when the first eccentric link 210 rotates with respect to the rotation shaft of the eccentric ring 100, the first eccentric link 210 moves while passing through the operation hole 332. The operation hole 332 may be formed in a direction perpendicular to the crankshaft 200 to be communicated with the outside. However, the operation hole 332 is not limited thereto, and a position of the operation hole 332 formed in a body 200 of the connecting rod 30 may be changed according to a position of the control shaft 50 for rotating the eccentric bearing assembly 30.

The control shaft 50 is coupled with the second eccentric link 210 to rotate the eccentric bearing assembly 30 as described above. A rotation angle of the control shaft 50 varies according to a compression ratio. Accordingly, the eccentric bearing assembly 30 adjusts a height of the piston 10 according to a change in the rotation angle of the control shaft 50. The control shaft 50 may be provided in parallel to the crank shaft 20. However, the control shaft 50 is not limited thereto, and may be provided at various positions according to a design thereof.

The variable compression ratio apparatus 1 according to the exemplary embodiment of the present invention may further include a controller. The controller changes a compression ratio of the mixer according to an operation condition of the engine. To this end, the controller rotates the control shaft 50 through a driving means, such as a motor.

Further, the aforementioned variable compression ratio apparatus 1 rotates the eccentric ring through the connection with the first to third eccentric links, but is not limited thereto, and the eccentric links may be variously combined.

In addition, the form, in which the respective eccentric links of the aforementioned variable compression ratio apparatus 1 are coupled by the shaft members, and the shaft members are inserted in the eccentric links so that the eccentric links are coupled, is suggested, but the respective eccentric links are not limited thereto, and may be coupled in various forms.

Furthermore, in the aforementioned variable compression ratio apparatus 1, the eccentric ring and the first eccentric link are separately provided to be inserted in the mounting hole and the operation hole, respectively, but are not limited thereto, and the eccentric ring and the first eccentric link are integrally formed so that the eccentric ring may be inserted in the mounting hole through the operation hole.

Figure 8:
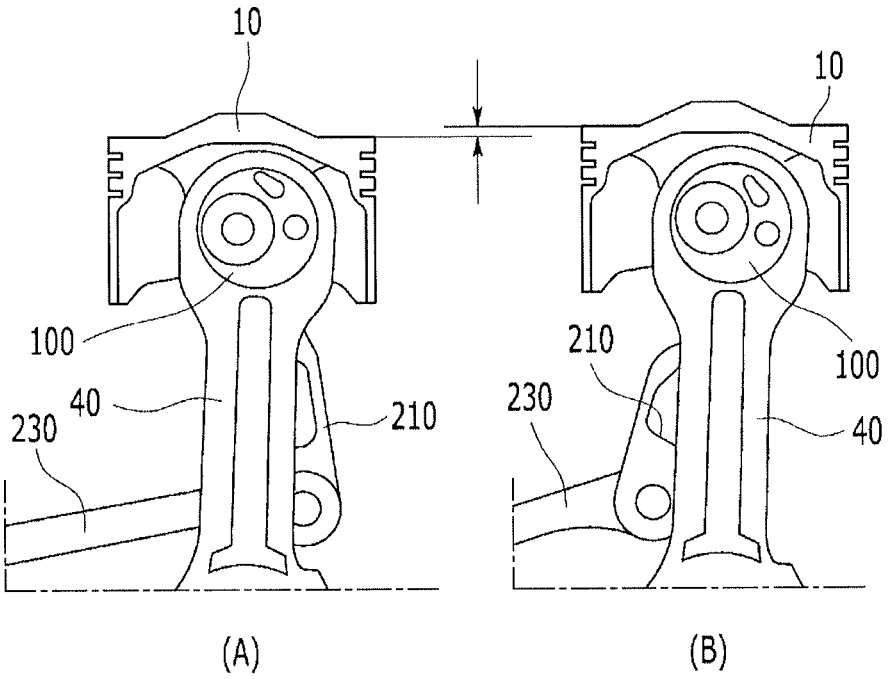
FIG. 8 is a schematic view of comparison between a low compression ratio operation condition and a high compression ratio operation condition of a variable compression ratio apparatus according to an exemplary embodiment of the present invention.
Figure 9:
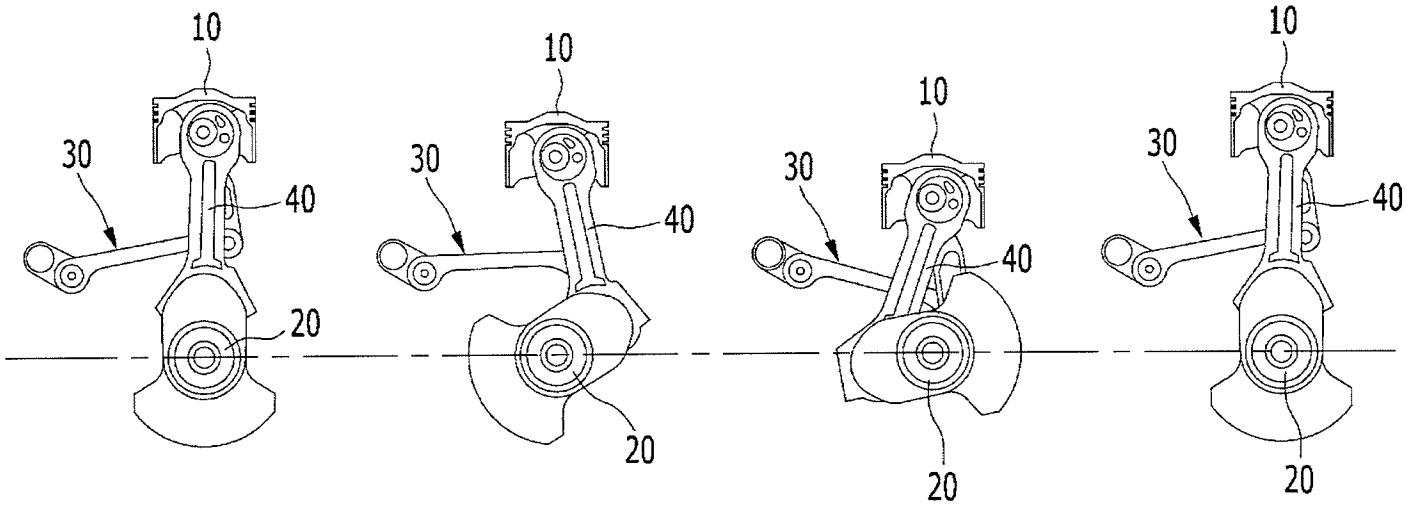
FIG. 9 is a schematic view illustrating an operation state of a variable compression ratio apparatus according to an exemplary embodiment of the present invention.

FIG. 8 is a schematic view of comparison between a low compression ratio operation condition and a high compression ratio operation condition of the variable compression ratio apparatus according to an exemplary embodiment of the present invention, and FIG. 9 is a schematic view illustrating an operation state of the variable compression ratio apparatus according to an exemplary embodiment of the present invention.

Hereinafter, an operation of the variable compression ratio apparatus according to the exemplary embodiment of the present invention will be described with reference to FIGS. 8 and 9.

Referring to FIG. 8, when the controller determines a compression ratio of the mixer according to an operation condition of the engine, whether to rotate the control shaft 50 and an angle of rotation of the control shaft 50 are determined. Accordingly, whether to rotate the second eccentric link 220 and an angle of rotation of the second eccentric link 220 are determined according to whether to rotate the control shaft 50 and the angle of the rotation of the control shaft 50. When the second eccentric link is rotated, the third eccentric link 230 and the first eccentric link 210 are rotated, and thus the eccentric ring 100 is rotated and a height of the piston 10 is changed. That is, when the crankshaft is positioned at the same position, the height of the piston 10 is changed according to the compression ratio.

Specifically, in the variable compression ratio apparatus 1, when the control shaft 50 is rotated in a clockwise direction in a low compression ratio operation condition A, the second eccentric link 220 turns in the clockwise direction to pull the third eccentric link 230. Accordingly, the first eccentric link 210 rotates in the clockwise direction and a position of the piston pin 12 rises. Accordingly, a distance between the piston pin 12 and a crank pin is elongated, so that a high compression ratio operation condition B is implemented.

Further, contrary to this, in the variable compression ratio apparatus 1, when the control shaft 50 is rotated in a counterclockwise direction in the high compression ratio operation condition B, the second eccentric link 220 turns in the counterclockwise direction to push the third eccentric link 230. Accordingly, the first eccentric link 210 rotates in the counterclockwise direction and a position of the piston pin 12 is lowered. Accordingly, a distance between the piston pin 12 and a crank pin is decreased, so that the low compression ratio operation condition A is implemented.

According to the aforementioned process, the eccentric bearing assembly 30 is positioned according to the determined compression ratio. The eccentric bearing assembly 30 according to the exemplary embodiment of the present invention is independently operated from the rotation of the crankshaft 20, so that as illustrated in FIG. 9, even though the height of the piston 10 is changed according to the rotation of the crankshaft 20, the angles of the eccentric ring 100, the first eccentric link 210, and the second eccentric link 220 are not changed.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable compression ratio apparatus mounted on an engine configured to receive combustion force of a mixer from a piston to rotate a crankshaft, and configured to change a compression ratio of the mixer, the apparatus comprising:

an eccentric bearing assembly connected with the piston through a piston pin, and including:

an eccentric ring including an eccentric hole through which the piston pin passes so that the piston pin is rotatably installed while being eccentric to the eccentric ring; and an eccentric link connected to the eccentric ring including the eccentric hole through which the piston pin passes, to transfer rotation force thereof to the eccentric ring;

a connecting rod having a body and including:

a first end provided with a mounting hole into which the eccentric ring is rotatably inserted;

a central portion provided with an operation hole formed in the body of the connecting rod by penetrating the body of the connecting rod along a length of the connecting rod, wherein the eccentric link is transversely movable relative to the connecting rod inside the operation hole by passing through the operation hole without contacting the connecting rod; and a second end rotatably connected to the crankshaft while being eccentric to the crankshaft; and a control shaft connected to the eccentric link and configured to rotate the eccentric bearing assembly, wherein the eccentric link and the connecting rod are separately rotatable.

2. The variable compression ratio apparatus of claim 1, wherein the operation hole communicates with the mounting hole.

3. The variable compression ratio apparatus of claim 1, wherein the operation hole is formed in a direction perpendicular to the crankshaft to be communicated with an outside of the connecting rod.

4. The variable compression ratio apparatus of claim 1, wherein the eccentric ring and the eccentric link are separately provided and coupled.

5. The variable compression ratio apparatus of claim 4, wherein an insertion hole in which an end of the eccentric link connected with the eccentric ring is inserted is formed in one surface of the eccentric ring, so that the eccentric ring is coupled with the eccentric link.

6. The variable compression ratio apparatus of claim 5, wherein a ball spring is coupled to an interior peripheral surface of the eccentric ring in which the insertion hole of the eccentric ring is formed, and wherein a coupling recess corresponding to the ball spring is formed at the end of the eccentric link, so that the eccentric ring is coupled with the eccentric link.

7. The variable compression ratio apparatus of claim 1, wherein the eccentric link includes:

a first eccentric link connected to the eccentric ring;

a second eccentric link connected to the control shaft; and a third eccentric link connecting the first eccentric link to the second eccentric link.

8. The variable compression ratio apparatus of claim 7, wherein a first link hole is formed at an end of the first eccentric link, and a second link hole is formed at an end of the third eccentric link, and wherein the first eccentric link is coupled with the third eccentric link by a first shaft member inserted in the first link hole and the second link hole.

9. The variable compression ratio apparatus of claim 8, wherein a third link hole passing through the first link hole in a side surface of the first link hole is formed at the end of the first eccentric link, and wherein the end of the third eccentric link is inserted in the third link hole and coupled thereto by the first shaft member.

10. The variable compression ratio apparatus of claim 8, wherein a fourth link hole is formed at an end of the second eccentric link, and a fifth link hole is formed at the other end of the third eccentric link, and wherein the second eccentric link is coupled with the third eccentric link by a second shaft member inserted in the fourth link hole and the fifth link hole.

11. The variable compression ratio apparatus of claim 10, wherein a sixth link hole passing through the fifth link hole in a side surface of the fifth link hole is formed at the other end of the third eccentric link, and wherein the end of the second eccentric link is inserted in the sixth link hole.

12. A variable compression ratio apparatus configured to change a compression ratio of a mixer flowing in a cylinder of an engine according to an operation condition of the engine, the apparatus comprising:

a piston vertically moving inside the cylinder;

a crankshaft provided at a lower end of the cylinder to be rotated by a vertical movement of the piston;

a balance weight connected to the crank shaft and reducing vibration generated during rotation of the crank shaft;

an eccentric ring connected with the piston through a piston pin, and including an eccentric hole through which the piston pin passes so that the piston pin is rotatably installed while being eccentric to the eccentric ring;

an eccentric link coupled with the eccentric ring including the eccentric hole through which the piston pin passes, to transfer rotation force to the eccentric ring;

a connecting rod having a body and including:

a first end provided with a mounting hole in which the eccentric ring is rotatably inserted;

a central portion provided with an operation hole formed in the body of the connecting rod by penetrating the body of the connecting rod along a length direction of the connecting rod and communicating with the mounting hole so that the eccentric link is transversely movable inside the operation hole relative to the connecting rod by passing through the operation hole, without contacting the connecting rod; and a second end rotatably connected to the crankshaft while being eccentric to the crankshaft; and a control shaft connected to the eccentric link and configured to rotate an eccentric bearing assembly, wherein the eccentric link and the connecting rod are separately rotatable.

13. The variable compression ratio apparatus of claim 12, wherein the operation hole communicates with the mounting hole.

14. The variable compression ratio apparatus of claim 12, wherein the eccentric link includes:

a first eccentric link connected to the eccentric ring;

a second eccentric link connected to the control shaft; and a third eccentric link connecting the first eccentric link to the second eccentric link.

15. The variable compression ratio apparatus of claim 14, wherein an insertion hole in which an end of the first eccentric link is inserted is formed in one surface of the eccentric ring.

16. The variable compression ratio apparatus of claim 15, wherein a ball spring is installed in an interior peripheral surface in which the insertion hole of the eccentric ring is formed, and wherein a coupling recess corresponding to the ball spring is formed at the end of the first eccentric link.

* * * * *